US008890765B1

(12) United States Patent
Dinh et al.

(10) Patent No.: US 8,890,765 B1
(45) Date of Patent: Nov. 18, 2014

(54) ANTENNA HAVING AN ACTIVE RADOME

(75) Inventors: Vincent V. Dinh, San Diego, CA (US); Howard L Dyckman, La Jolla, CA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 320 days.

(21) Appl. No.: 13/452,840

(22) Filed: Apr. 21, 2012

(51) Int. Cl.
*H01Q 1/42* (2006.01)

(52) U.S. Cl.
USPC ..... 343/872

(58) Field of Classification Search
USPC ..... 343/872, 841, 702
See application file for complete search history.

(56) References Cited

U.S. PATENT DOCUMENTS

| | | | | |
|---|---|---|---|---|
| 5,767,807 | A * | 6/1998 | Pritchett | 342/374 |
| 6,774,852 | B2 * | 8/2004 | Chiang et al. | 343/700 MS |
| 7,030,834 | B2 | 4/2006 | Delgado et al. | |
| 7,088,308 | B2 | 8/2006 | Delgado et al. | |
| 7,480,502 | B2 * | 1/2009 | Biddulph | 455/416 |
| 7,656,360 | B2 * | 2/2010 | Hirabayashi | 343/818 |
| 7,881,752 | B1 * | 2/2011 | Johnson et al. | 455/562.1 |
| 7,928,924 | B1 | 4/2011 | Hendrickson et al. | |
| 8,174,452 | B2 * | 5/2012 | Ayala Vazquez et al. | 343/702 |
| 8,259,020 | B1 * | 9/2012 | Macy et al. | 343/766 |
| 2007/0080891 | A1 * | 4/2007 | De Lustrac et al. | 343/909 |
| 2008/0025208 | A1 * | 1/2008 | Chan | 370/217 |
| 2009/0109115 | A1 | 4/2009 | Dittrich et al. | |
| 2010/0271284 | A1 * | 10/2010 | Pendry et al. | 343/910 |
| 2010/0302014 | A1 * | 12/2010 | Gloo et al. | 340/326 |

OTHER PUBLICATIONS

Hongsheng Chen et al., Controllable Left-Handed Metamaterial and Its Application to a Steerable Antenna, Aug. 2, 2006, 053509, pp. 103, Applied Physics Letters 89, American Institute of Physics, USA.
Tao Jiang et al., Low-DC Voltage-Controlled Steering-Antenna Radome Utilizing Tunable Active Metamaterial, Jan. 2012, pp. 170-178, vol. 60, No. 1, IEEE Transactions on Microwave Theory and Techniques, USA.
Guillaume Lunet et al., Meta-material With Tunable Thin Film Material for the Conception of Active Radome, Sep. 29, 2009, pp. 602-605, Proceedings of the 39th European Microwave Conference, Rome, Italy.

* cited by examiner

*Primary Examiner* — Huedung Mancuso
(74) *Attorney, Agent, or Firm* — SPAWAR Systems Center Pacific; Arthur K. Samora; Kyle Eppele

(57) ABSTRACT

An antenna having an active radome for beam steering and/or nulling in accordance with several embodiments can include at least one omni-directional radiating element, a radome surrounding the radiating element, and a network of conductive segments that can be placed between the radome and radiating element. A plurality of switches can interconnect the conductive segments to form the network. The switches can be FET, MOSFET and optical switches, and can be selectively closed when the element radiates or receives RF energy to selectively establish connectivity between the conductive segments, which can achieve a selective Yagi-like effect for the antenna. The conductive segments network can have any geometric profile when viewed in top plan, such as octagonal, square and the like, provided the segments surround the radiating element. A processor can be used to provide a control algorithm, which can contain non-transitory written directions that selectively activate and deactivate the switches.

16 Claims, 4 Drawing Sheets

ANTENNA HAVING AN ACTIVE RADOME

FEDERALLY-SPONSORED RESEARCH AND DEVELOPMENT

This invention (Navy Case No. 101154) is assigned to the United States Government and is available for licensing for commercial purposes. Licensing and technical inquires may be directed to the Office of Research and Technical Applications, Space and Naval Warfare Systems Center, Pacific, Code 72120, San Diego, Calif. 92152; voice (619) 553-5118; email ssc_pac_T2@navy.mil.

FIELD OF THE INVENTION

The present invention pertains generally to antenna systems that have possibly omni-directional radiating elements. More specifically, the present invention pertains to antenna systems and methods for manufacture there for that allow for beam steering and nulling of an antenna having a single or multiple elements by modifying the structure of the antenna radome, which allows for beam steering and nulling using minimal antenna element transmission resources.

BACKGROUND OF THE INVENTION

There are many transceivers in the prior having single-element antennas, such as GPS devices, for example. GPS devices can often include single-element antenna elements because of cost and size constraints. Other platforms which can include single-element antennas can include UUV's and UAV's and small maritime platforms. These types of platforms have extremely constrained antenna footprints, and space for these antennas is at a premium. The resulting received signals from such GPS devices and such platforms can be extremely weak and corrupted by interference. The resulting transmitted signals from such platforms may be weak in desired directions. One way to "boost" the reception power of such devices is to employ phased array antennas that have multiple receiving/radiating elements, such as Controlled Reception Pattern Antennas (CRPA). But these types of systems can often require more space than that allotted for the platform. Additionally, the control requirements, costs, and electronics to drive the multiple elements for such antennas can be unduly burdensome to the platform. On the other hand, legacy systems employing a single-element antenna such as a Fixed Reception Pattern Antenna (FRPA) antenna are susceptible to interference.

As mentioned above, beam steering can be generally accomplished with multiple element phased-arrays. Recently, there has been some interest in making active (or beam-steering) radomes using metamaterials. Such radomes take advantage of the phenomena caused by wave interaction due to passing the RF through a thick radome made of metamaterials. However, these techniques can place a strong dependency on the radome material, which imposes certain requirements such as attenuation, frequency response, weight and size. With regard to weight and size in particular, the use of metamaterials for active radome beam steering may be a huge disadvantage for a small airborne platforms such as UAV's.

In view of the above, it is an object of the present invention to provide an active radome that allows for beam steering and nulling, with potentially multiple beams or nulls, with a single element for radiating or receiving radiofrequency (RF) energy, which results in a more agile single-element GPS antenna or other receiving or transmitting antenna. Another object of the present invention is to provide an active radome with the employed switched conducting elements, such that a thick slab for the radome is not required, while still achieving the desired wave changes (beam steering/nulling). Still another object of the present invention is to provide an active radome with conductive switching elements rather than metamaterials, which may result in an improved frequency response for the overall antenna, while significantly reducing the radome attenuation, weight and size properties, which are of great concern on mobile platforms. Another object of the present invention is to provide an active radome that mitigates interference affecting an existing antenna by effectively using minimal resources and without the need to replace the antenna. Still another object of the present invention is to provide a radome for a single-element antenna that provides directionality for that antenna within a confined space. Yet another object of the present invention is to provide an active radome that can be adapted to be back-fit over an existing antenna, along with circuitry that adaptively controls the various elements in the radome. Another object of the present invention is to provide an active radome that is easy to manufacture in a cost-effective manner.

SUMMARY OF THE INVENTION

An antenna in accordance with several embodiments of the present invention can include at least one omni-directional element for radiating or receiving radiofrequency (RF) energy and an active radome surrounding the radiating element, with the radome having an internal and an external surface. A plurality of conductive segments can be placed between the radome and the element, or on the inside surface of the radome. A plurality of switches can interconnect the conductive segments to form a network of conductive segments that surrounds the radiating element.

The switches can be MOSFET, JFET, relay, or optical switches, or switches of other types, and the switches can be selectively activated in real time when the element radiates or receives RF energy to establish connectivity between the conductive segments as selected by the user, to thereby establish an effect similar to the"Yagi" effect, thus producing the desired directionality for the antenna. The conductive segments network can surround the element and can have an octagonal, square, polygonal of other order, or circular profile when viewed in top plan. Other geometric profiles are also possible, as long as the conductive segments enclose or surrounding the radiating element. The conductive segments network can also be fixed to the radome and conform to the shape of the radome. The antenna can further include a processor, which can contain non-transitory written directions that selectively activate and deactivate the switches to establish the Yagi-like effect for the possible omni-directional element or elements. The radome can further be manufactured from an RF energy transparent material, or contain metamaterial with customized electric permittivities and/or magnetic permeabilities in various places to enhance the aforementioned directional effect of the antenna.

BRIEF DESCRIPTION OF THE DRAWINGS

The novel features of the present invention will be best understood from the accompanying drawings, taken in conjunction with the accompanying description, in which similarly-referenced characters refer to similarly-referenced parts, and in which.

DETAILED DESCRIPTION OF THE EMBODIMENTS

Figure 1:
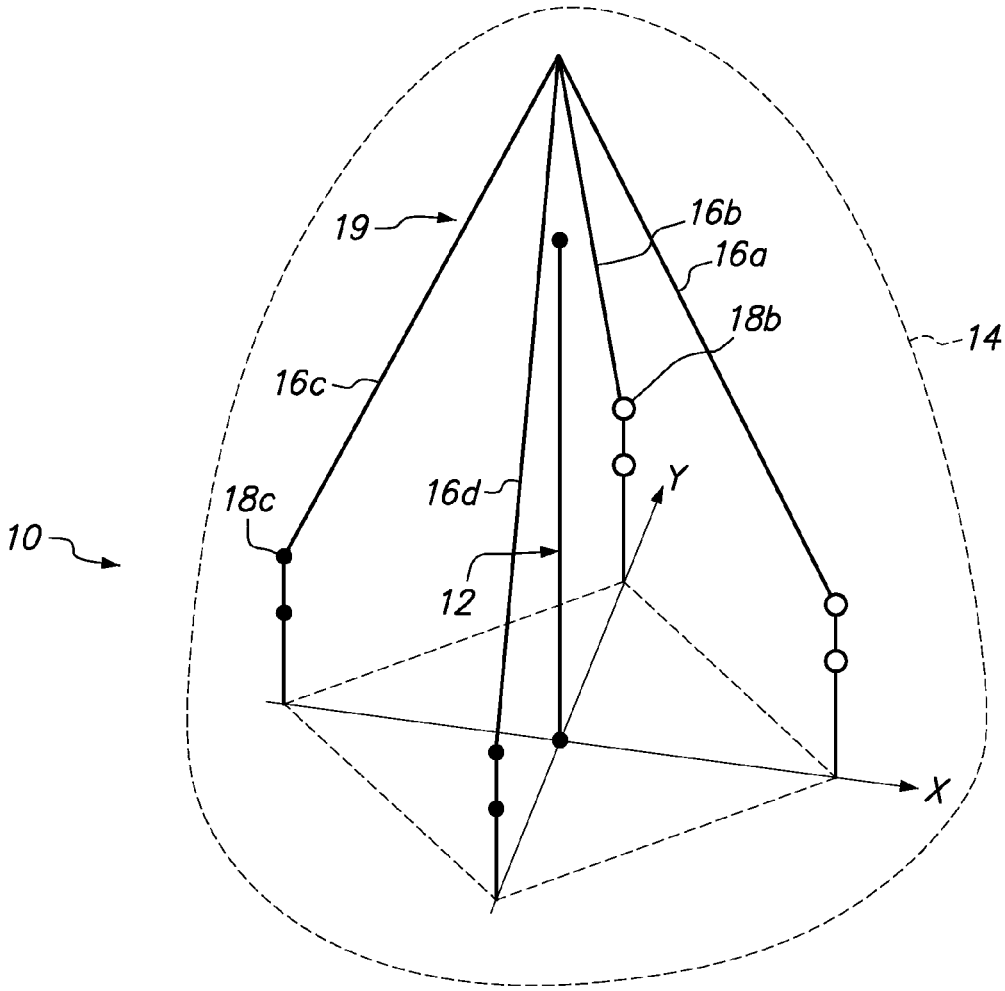
FIG. 1 is a drawing of an antenna having an active radome according to several embodiments of the present invention, with the radome shown in phantom to illustrate certain operative aspects of the invention in greater clarity.

Referring initially to FIG. 1, an antenna having an active radome is shown and is generally designated by reference character 10. As shown, antenna 10 can include an element 12 and a radome 14 that surrounds element 12 (the radome is shown in phantom in FIG. 1). In several embodiments, element 12 can be radiating or receiving radiofrequency (RF) energy in a substantially omni-directional manner. The structure and methods of several embodiments can be used to achieve a pseudo-Yagi, or directivity effect for radiating or receiving RF (depending on whether the antenna is transmitting or receiving) in a manner more fully described below. A plurality of conductive segments 16, of which segments 16*a*-16*d* are representative, is also shown in FIG. 1. The segments can be placed in a surrounding relationship around element 12, and the elements can be interconnected by a plurality of switches 18, of which switches 18*a*-18*d* are representative (switch 18*a* is representative of an open switch in FIG. 1, while switch 18*c* is representative of a closed switch).

Figure 2:
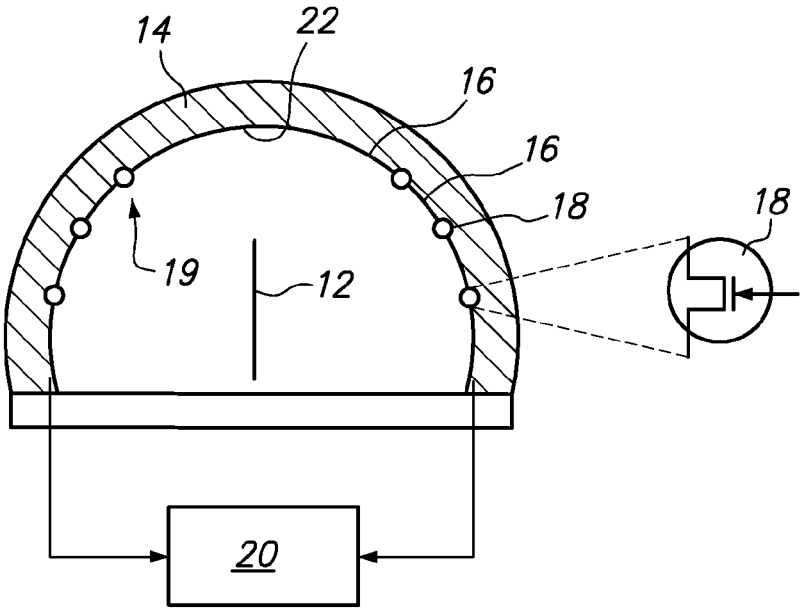
FIG. 2 is a cross-sectional view of the antenna of FIG. 1, but with the conductive segments network arranged in a hemispherical plan to conform to the shape of the radome.
Figure 3:
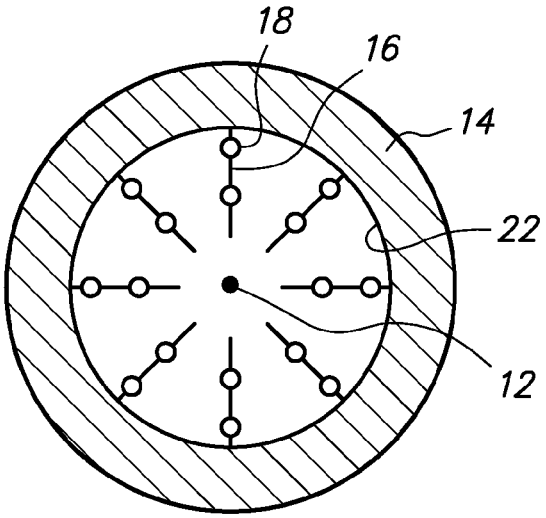
FIG. 3 is a bottom plan view of the antenna of FIG. 2.

Conductive segments 16 and switches 18 can cooperate to define a network 19 for antenna 10. As shown in FIGS. 1-3, network 19 can be located between element 12 and radome 14, in order to protect network 19 and element from the weather, for example. However, this is not necessarily required; network 19 could also be located within or outside of radome 14, or radome 14 could be absent, provided the surrounding relationship with element 12 is maintained.

Figure 5:
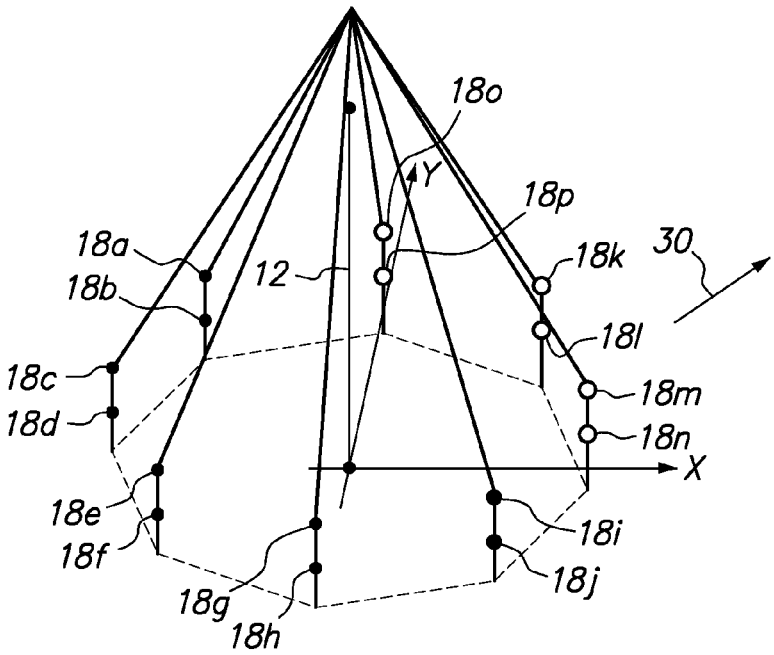
FIG. 5 is a side elevational view of the conductive segments and switches portions of yet another embodiment of the present invention, with the radome removed for clarity; and, FIG. 6 is a graph of the simulated radiofrequency (RF) output in decibels (dB), which illustrates the directivity effect of the present invention according to several embodiments.

In FIG. 1, conductive segments 16 can be arranged with respect a given x-axis and y-axis to form a square profile when the network 19 is viewed in top plan; however, other arrangements can be used. For example, and as shown in FIGS. 2-3, the conductive segments 16 can be fixed to the internal surface 22 of radome 14. With this configuration, the network 19 has a hemispherical configuration when viewed in side elevation (FIG. 2), and a circular profile when viewed in plan view (FIG. 3 is a bottom plan view). In yet another configuration, and as shown in FIG. 5, network 19 can be configured so that it has an octagonal profile when viewed in top plan. The number of conductive segments 16 and switches 18 that can be used to establish network 19, and the geometry of network 19, can be determined by the user based such factors as the space available for the network, the space available for the surrounding radome 14, the results of calculations and/or simulations that optimize the configuration to achieve the desired directivity, whether the geometry of the network 19 must conform to the geometry of the internal surface 22 of the radome, the desired directional gain of the antenna, the cost of switches 18 and conductive segments 16, and similar types of considerations. The number and arrangement of conducting elements and switches can be designed with the help of electromagnetic calculations and simulations that provide the directional gain pattern achieved for a given arrangement of conducting elements and switches when particular subsets of the switches are open or closed. Optimization of conducting elements and switches can be performed with a gradient method or any other computational method.

Figure 4:
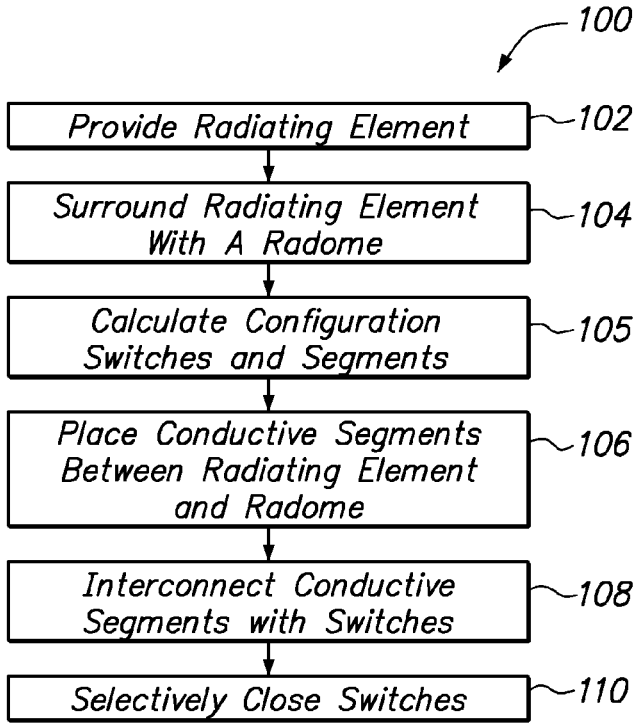
FIG. 4 is a block diagram of steps that can be taken to accomplish the methods according to several embodiments of the present invention.

Referring now to FIG. 4, the methods for establishing a pseudo-Yagi directivity effect according to several embodiments can be illustrated by block diagram 100, and can include the initial step 102 or providing at least one element. Another step for the methods according to several embodiments (represented by box 104) can be to surround the element 12 with a radome 14. Another step for the methods according to several embodiments (represented by box 105) can be to calculate and/or simulate the electromagnetic fields for various configurations of conducting segments 16 and switches 18 and various patterns of open and closed switches 18, in order to design a configuration for the network 19 that meets desired, predetermined directionality specifications. The methods can further include placing conductive segments between the element 12 and the radome 14 in the predetermined configuration based on the results of the aforementioned calculations (step 105), as indicated by step 106 in FIG. 4, and interconnecting the conductive segments with switches, as shown by step 108. The completion of steps 106 and 108 establish the network 19 for the device, the structure of which is described above.

The geometry of the network 19 can be circular, square or octagonal, or any other shape when viewed in a plan view, according to needs of the user and the results of the computational step 105, as also described above. Finally, the switches can be selectively opened and closed according to a predetermined algorithm (not shown), as indicated by step 110 in FIG. 4. Referring back to FIG. 2, a processor 20 is shown connected to network 19. Processor 20 can include non-transitory written instructions that, when accomplished, can accomplish the methods according to the embodiments described above, as well as other embodiments, and can also accomplish step 110 according to the desired algorithm, which can be predetermined and set by the user using the aforementioned non-transitory written instructions. Processor can also perform 105, although step 105 could be performed separately with another processor that is not shown in the Figures.

The switches 18 can be connected to the processor 20 with optical fibers or with wires. When wires are used, the wires can have a high resistivity, which is sufficiently high to minimize the effect of the wires on the electromagnetic field patterns and hence on the directionality performance of the antenna 10. In other embodiments, the switches can be controlled by electric or magnetic or RF or optical signals, which can be sent to the switches wirelessly (without wires or optical fibers connected to network 19), and can operate in a manner similar to RFID (Radio Frequency Identification) technology, i.e. by using RFID tags. Or, in a manner similar to RFID, each switch can have a built-in electronic address for use by the control signals, can harvest energy from the control signal energy, and can open or close in response to control signal commands that are directed to it by means of its own address.

Referring now to FIG. 5, the operation of antenna 10 can now be described. FIG. 5 illustrates a configuration for antenna 10 (with radome 14 removed for clarity) wherein network 19 has an octagonal profile when viewed in top plan, and further wherein switches 18*a*-18*j* are closed, and switches 18*k*-18*p* are open. With this configuration, when radiating element 12 is energized, switches 18*a*-18*p* cooperate to establish a Yagi-like directivity effect for antenna 10. More specifically, the closed switches 18*a*-18*j* cause the corresponding conductive segments 16 that switches 18*a*-18*j* interconnect to function as reflector element, while open switches 18*k*-18*p* function to cause corresponding conductive segments 16 to function as a director. (If the antenna is being used to radiate, the radiating element 16, when energized with radiofrequency (RF) energy, functions as the Yagi driver). For the configuration shown in FIG. 5, the net result upon energizing radiating element 12 with RF energy, or connecting a receiver to receiving element 12, is a directional beam (the "Yagi" directivity effect) in the direction shown by arrow 30, even though element 12 is omni-directional in azimuth when considered by itself as an element. Note that the direction of radiating or receiving RF energy (arrow 30) can be manipulated by the opening and closing of switches 18*a*-18*p*, which can be further controlled according to several embodiments by the processor 20 shown in FIG. 2.

Figure 6:
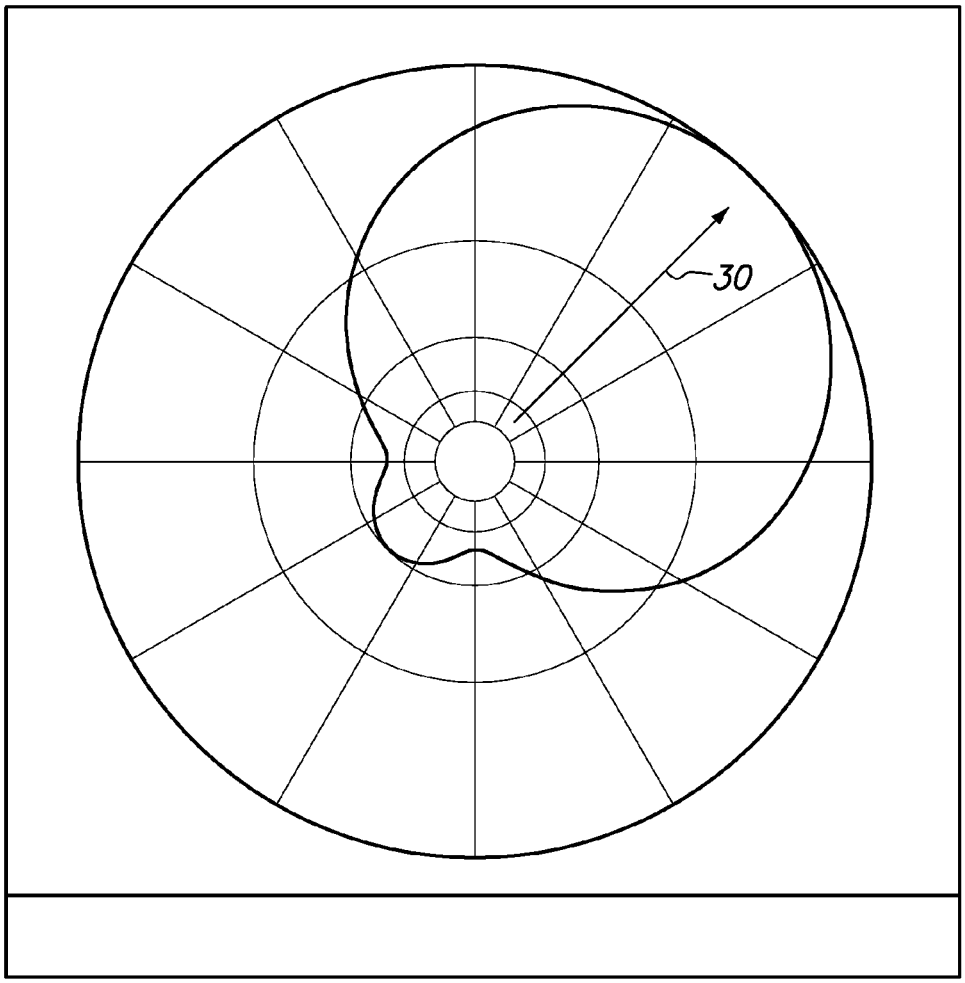

FIG. 6 is a graph that illustrates the increase in gain for the antenna shown in FIG. 5 where the conductive segments 16 range in size from three centimeters (3 cm) to approximately ⅓ meter in length and the gap between conductive segments 16 is 0.06 millimeters (0.06 mm). For the present embodiments, the lengths of conductive segments are determined by simulations with NEC-2 electromagnetic software and the gap is determined by the switching technology used. According to several embodiments, MOSFET, JFET, relays, or optical switches could be used. FIG. 6 illustrates gain results for an antenna wherein the conductive segments can be made of metal and for a gap that is suitable for the use of MOSFET or JFET types of switches 18. For these parameters, FIG. 6 illustrates an overall directivity of 11.14 dB, when driven at 1500 MHz, with a maximum directivity in the direction indicated by arrow 30. The signal strength varies by more than 25 dB over azimuth direction. These numbers are illustrative of the method but are not the limits of what can be achieved. In comparison, the overall directivity with all switches open for this configuration, which produces an approximate omni-directionality in azimuth at a gain of about 5.98 dB.

In still other embodiments of the antenna 10, multiple networks 19 and optionally radomes 14 can be used to enhance the directionality effect of the device. For these embodiments the multiple network 19 and/or radomes 14 can be arranged concentric to each other, with each radome 14 and network 19 having a surrounding relationship with radiating element 12. Or, if directionality in a particular direction or directions is desired, and the desired of direction(s) will not change, the networks and radomes can be placed to enhance the reflector element and director element function of the Yagi effect in a specific direction or directions when the corresponding switches 18 are closed as described above. Additionally, the radome 14 can be made of metamaterials, either uniformly or in specific portions of the radome 14, in order to further enhance the directionality of the antenna. Metamaterials with electric permittivity and/or magnetic permeability could be used (for purposes of this disclosure a metamaterial is a material whose electric permittivity and/or magnetic permeability has been designed, typically by embedding microscopic or small elements into the radome material to meet desired criteria). Materials that could be used for the conductive segments 16 and 18 are described above, although other materials could be used.

A prior art Yagi antenna achieves directionality by means of one or more reflector elements and one or more director elements. For the present invention according to several embodiments, an antenna 10, or an antenna having an active radome 14, can have elements that function in a similar manner to the reflector and director elements of a Yagi antenna. An active radome can have elements that do not function as reflector or director elements. An active radome can function in a manner similar to a Yagi antenna, and the resemblance has been noted herein. However, in some embodiments an active radome can function differently from a Yagi antenna.

The use of the terms "a" and "an" and "the" and similar references in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A antenna, comprising:

at least one element for radiating or receiving radiofrequency (RF) energy;

at least one radome surrounding said at least one element;

a plurality of conductive segments placed between said element and said radome said radome enclosing said plurality of conductive segments;

wherein said conductive segments are arranged in a network, said network surrounding said element and having an octagonal shape when viewed in top plan; and, a plurality of switches interconnecting said conductive segments so that said conductive segments form a conductive network that surrounds said element when viewed in side elevation, said switches being selectively closed when said element radiates or receives said RF energy, to selectively establish conductivity between said conductive segments and thereby to enable altering the directivity of said antenna in real time.

2. The antenna of claim 1, wherein said switches are selected from the group consisting of MOSFET, JFET, relay or optical switches.

3. The antenna of claim 1, wherein said conductive segments are arranged in a network, said network surrounding said element and having a circular shape when viewed in top plan.

4. The antenna of claim 1, wherein said conductive segments are arranged in a network, said network surrounding said element and having a square shape when viewed in top plan.

5. The antenna of claim 1, wherein said radome is made of a metamaterial.

6. The antenna of claim 1 further comprising:

a processor, said processor containing a non-transitory control algorithm that selectively activates and deactivates said switches to alter said directivity of said antenna.

7. The antenna of claim 1 wherein said radome has an internal surface and an external surface, and further wherein said conductive elements are fixed to said internal surface.

8. A method for establishing a directivity effect in an antenna, comprising the steps of:

A) providing at least one omni-directional element adapted to radiate or receive RF energy;

B) surrounding said element with a radome, said radome having an internal and an external surface;

C) placing a plurality of conductive segments on said radome or between said radome and said radiating element, said radome enclosing said plurality of conductive segments, said step C) being accomplished so that said network has an octagonal shape when viewed in top plan;

D) interconnecting said conductive segments with a plurality of switches so that said conductive segments form a conductive network that surrounds said element when viewed in side elevation, said step D) being accomplished using switches selected from the group consisting of MOSFET, JFET, relay or optical switches; and, E) selectively closing and opening said switches when said element radiates or receives RF energy.

9. The method of claim 8, wherein said step C) is accomplished so that said network has a circular shape when viewed in top plan.

10. The method of claim 8, wherein said step C) is accomplished so that said network has a square shape when viewed in top plan.

11. The method of claim 8, wherein said step B) is accomplished using a radome that is made of a metamaterial.

12. The method of claim 8, wherein said step E) is accomplished using a processor, where said processor contains non-transitory written directions that selectively activate and deactivate said switches to establish said directivity effect for said antenna.

13. The method of claim 8, wherein step C) is accomplished by fixing said conductive segments to said internal surface of said radome.

14. The method of claim 12, wherein said step E) is accomplished by connecting said switches to said processor with connections selected from the group consisting of optical fibers or highly-resistant wires, to minimize the effect of said step E) on said directivity effect.

15. The method of claim 12, wherein said step E) is accomplished wirelessly using RFID (Radio Frequency Identification).

16. The method of claim 12 further comprising the steps of:

B1) providing a second radome that is concentric to said first radome;

C1) locating a second plurality of conductive segments between said radome from said step B) and said second radome;

D1) interconnecting said second plurality of conductive segments with a second plurality of switches; and, E1) selectively closing said switches from said steps D1); and, F) accomplishing said step E) and said step E1) with the same said processor.

* * * * *